US011060514B2

(12) United States Patent
Albert

(10) Patent No.: US 11,060,514 B2
(45) Date of Patent: Jul. 13, 2021

(54) COLLAPSING BEAM PUMP

(71) Applicant: Tactopack, Inc., Pelham, NY (US)

(72) Inventor: Jonathan D. Albert, Philadelphia, PA (US)

(73) Assignee: TACTOPACK, INC., Pelham, NY (US)

( * ) Notice: Subject to any disclaimer, the term of this patent is extended or adjusted under 35 U.S.C. 154(b) by 206 days.

(21) Appl. No.: 16/278,361

(22) Filed: Feb. 18, 2019

(65) Prior Publication Data

US 2019/0257303 A1 Aug. 22, 2019

Related U.S. Application Data

(60) Provisional application No. 62/632,250, filed on Feb. 19, 2018.

(51) Int. Cl.

| | |
|---|---|
| ***F04B 23/02*** | (2006.01) |
| ***F04B 43/08*** | (2006.01) |
| ***F04B 9/14*** | (2006.01) |
| ***F04B 33/00*** | (2006.01) |
| ***F04B 43/00*** | (2006.01) |
| ***B05B 11/00*** | (2006.01) |
| ***B67D 3/04*** | (2006.01) |

(52) U.S. Cl.

CPC ..... *F04B 23/021* (2013.01); *B05B 11/3028* (2013.01); *B67D 3/041* (2013.01); *F04B 9/14* (2013.01); *F04B 33/00* (2013.01); *F04B 43/0054* (2013.01); *F04B 43/08* (2013.01); *F04B 43/084* (2013.01)

(58) Field of Classification Search

CPC .... F04B 23/021; F04B 43/0054; F04B 43/08; F04B 43/084; B65D 35/28; B67D 3/041; B67D 1/108; B67D 1/1279; A47K 5/1215; B05B 11/3028

See application file for complete search history.

(56) References Cited

U.S. PATENT DOCUMENTS

| | | | | |
|---|---|---|---|---|
| 4,101,057 | A * | 7/1978 | LoMaglio | B05B 11/303 222/207 |
| 4,411,652 | A * | 10/1983 | Kramer | A61M 5/14224 417/478 |
| 4,882,978 | A * | 11/1989 | Bruggeman | F04B 33/00 92/34 |
| 4,961,508 | A * | 10/1990 | Weimer | B67D 1/0001 222/183 |
| 5,584,667 | A * | 12/1996 | Davis | A61M 5/142 417/474 |
| 2012/0189371 | A1* | 7/2012 | Morelli | A47L 13/19 401/7 |
| 2014/0367422 | A1* | 12/2014 | Drennow | B67D 7/36 222/207 |
| 2017/0045045 | A1* | 2/2017 | Tseng | F04B 9/14 |

* cited by examiner

*Primary Examiner* — Charles G Freay

(74) *Attorney, Agent, or Firm* — Leason Ellis LLP

(57) ABSTRACT

A pump is configured to operate due to the bending of the pump. The pump can be used in a variety of applications including a dispensing application in which the pump is housed within a pouch. This type of pump takes advantage of the inherent flexible nature of the pouch.

16 Claims, 5 Drawing Sheets

COLLAPSING BEAM PUMP

CROSS REFERENCE TO RELATED APPLICATION

The present invention claims the priority to and the benefit of U.S. patent application Ser. No. 62/632,250, which was filed on Feb. 19, 2018, which is hereby incorporated by reference in its entirety.

BACKGROUND

There are a number of different types of pumps that are all configured to controllably move fluid along a circuit.

For example, peristaltic pumps, as shown in FIG. 1, are a common method for pumping fluids. The operation of this type of pump involves compressing a flexible tube 3 in at least two locations and advancing these pinched points 2 so as to transport fluid within the tube. Element 4 can be in the form of a back wall or support against which the tube 3 is compressed. This type of pump has many advantages including simplicity and the fact that the fluid only touches the inside of the tube. Peristaltic pumps are typically implemented using a series of roller 2 mounted on a rotating armature 1 in a style termed a rotary peristaltic pump. There are also versions that are linear, as shown in FIG. 2, that required timed coordination of the compression of the pinch points on the tube.

A squeeze bulb type pump 5, as shown in FIG. 3, is used to pump fuel and other fluids. The pump consists of an inlet, and outlet, a deformable bulb, and two check valves. When the bulb is compressed by gripping and squeezing with a hand the fluid is pressurized, the ball of the outlet check valve opens to allow the fluid to exit the outlet. As the bulb returns to its original shape, there is negative pressure in the bulb that causes the inlet check valve to open and fluid is sucked into the bulb.

Another common pump is a fuel priming pump 6, as shown in FIG. 4, used in small engines like lawn mower and chain saws. In this style of pump, there is a deformable bubble 7 made of an elastomeric material and a combination duckbill umbrella valve which provides two one-way valves in a single part. When the bulb is depressed, the fluid is expelled through the lips of the duckbill valve to the outlet. When the bubble returns to its original shape, the outlet closes, the inlet umbrella opens, and fuel is sucked into the bubble.

SUMMARY

This invention is directed to a pump that operates due to the bending of the pump. The pump according to the present invention can be used in a variety of applications including a dispensing application in which the pump is housed within a pouch. This type of pump takes advantage of the inherent flexible nature of the pouch.

The present pump is simple to make and can be made from injection molded parts and can generate sufficient pressure to dispense or spray a fluid. It can also be designed to work with a wide range of fluid viscosities.

BRIEF DESCRIPTION OF DRAWING FIGURES

DETAILED DESCRIPTION OF CERTAIN EMBODIMENTS

Figure 1:
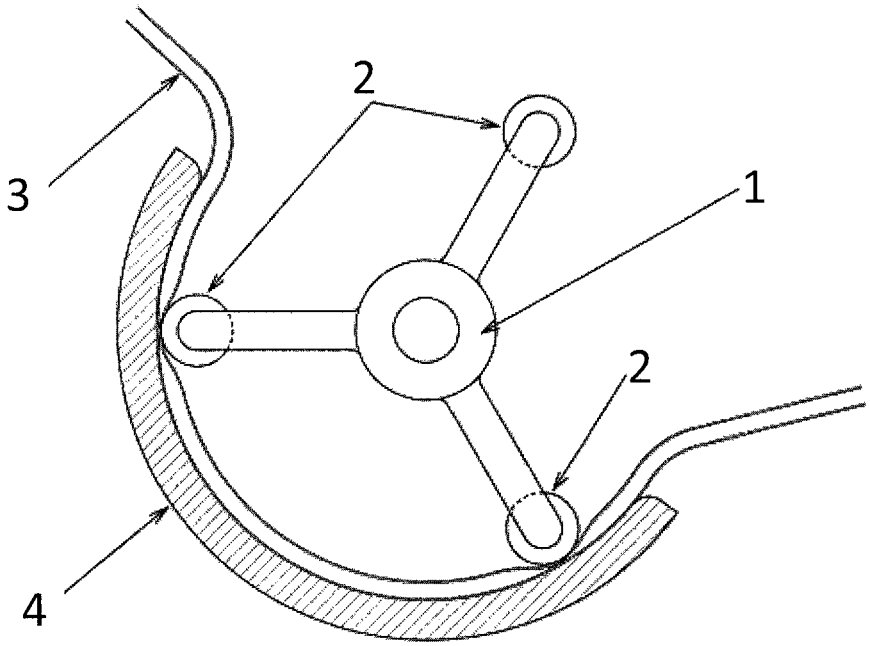
Fig. 1 (Prior Art)
FIG. 1 is a side elevation view of a traditional peristaltic pump.
Figure 2:
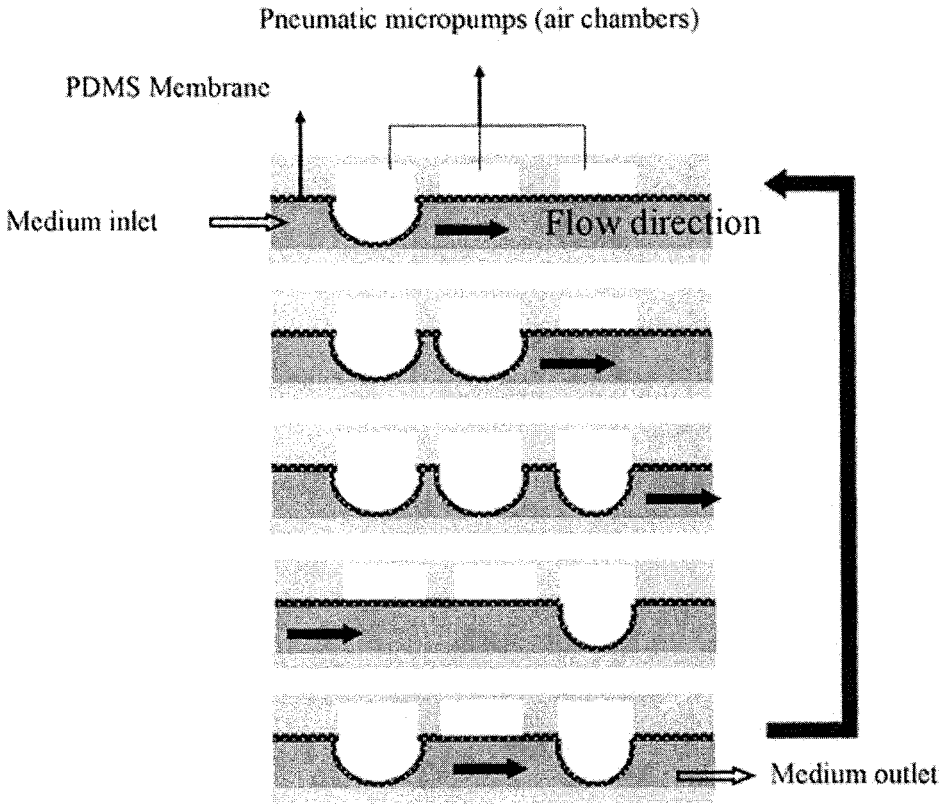
Fig. 2 (Prior Art)
FIG. 2 is a side elevation view of a peristaltic pump with a series of rollers.
Figure 3:
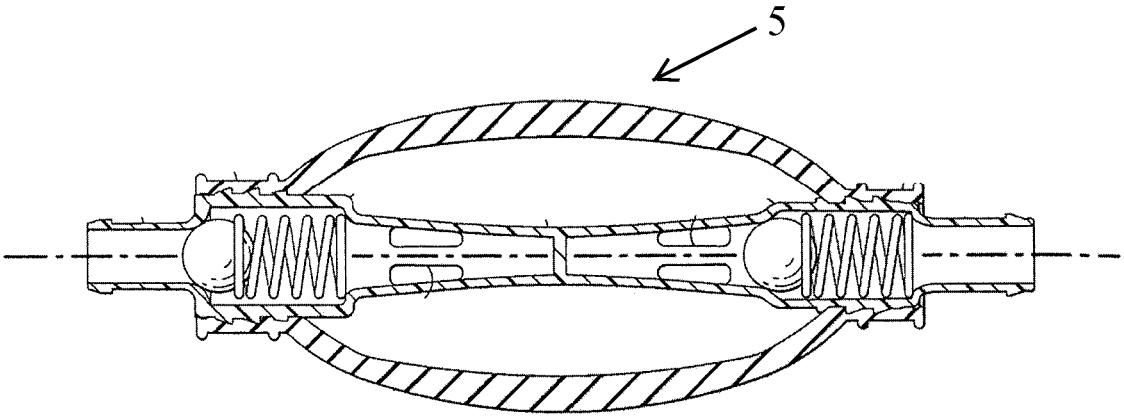
Fig. 3 (Prior Art)
FIG. 3 is a cross-sectional view of a squeeze bulb type pump.
Figure 4:
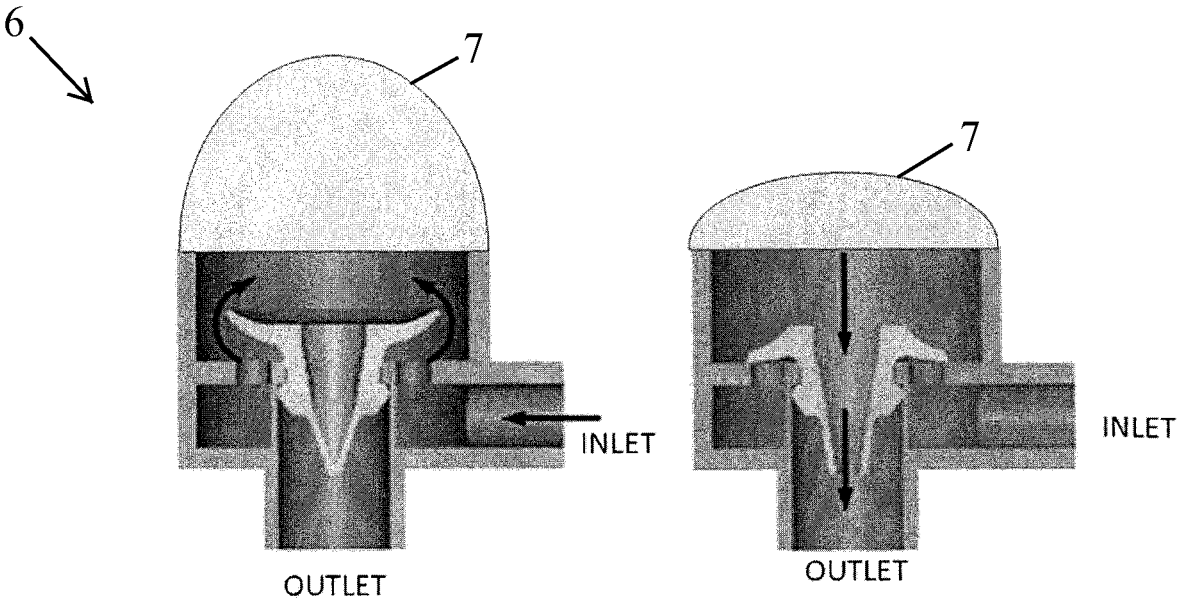
Fig. 4 (Prior Art)
FIG. 4 is a cross-sectional view of a traditional fuel priming pump.
Figure 5:
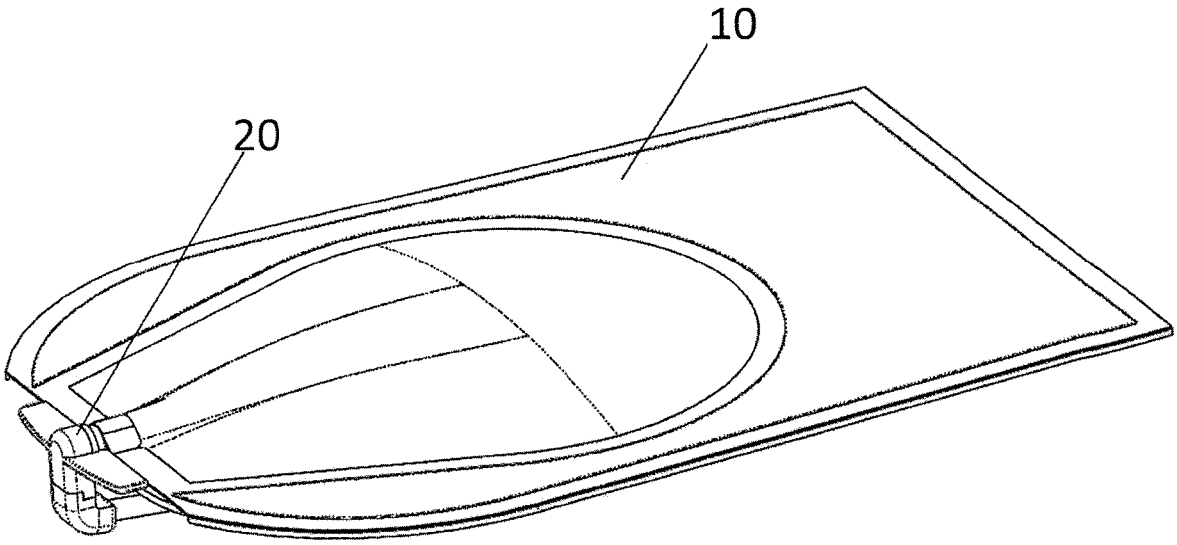
FIG. 5 is a side perspective view of a fluid dispensing device according to one exemplary embodiment of the present invention.
Figure 6:
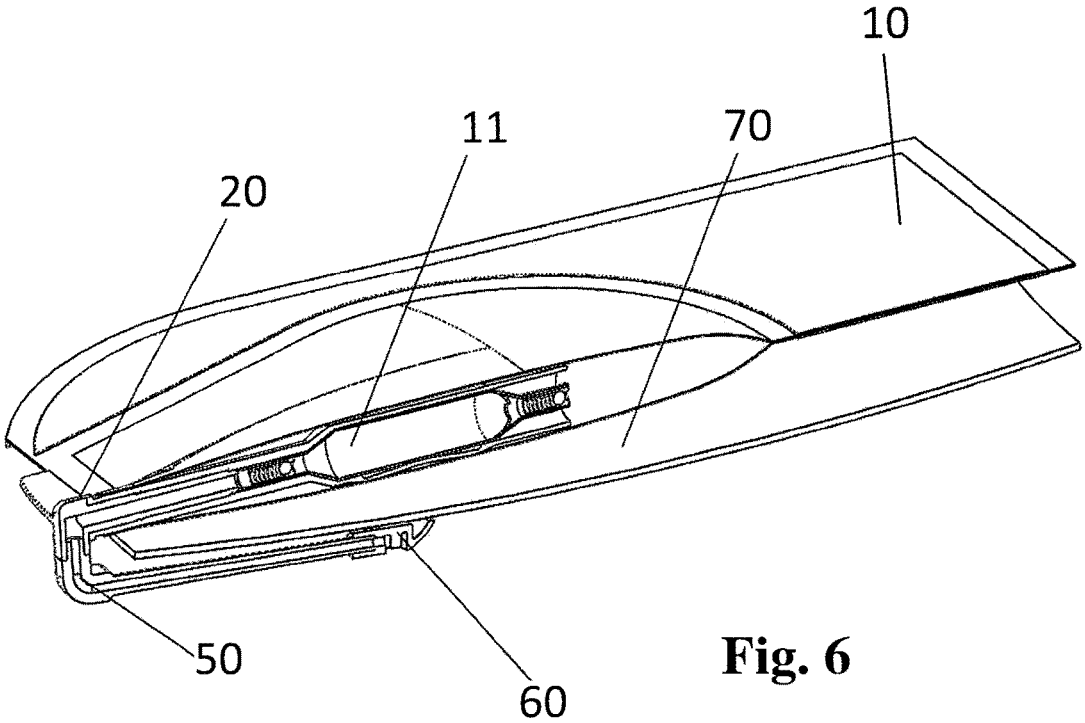
FIG. 6 is a cross-sectional perspective view of the fluid dispensing device.

FIGS. 5 and 6 show one exemplary pump 11 in accordance with the present invention and being integrated into a dispensing device, such as a pouch 10, that has an external tube (conduit) 20 to direct the flow from a fluid reservoir through the external tube 20 to an external location. The pouch 10 can be of a similar construction as pouches disclosed in US patent applications filed by the present applicant including U.S. Pat. Nos. 9,326,645 and 9,808,130 and U.S. patent application Ser. Nos. 15/294,204 and 15/449,265, each of which is hereby incorporated by reference in its entirety. However, it will be understood that a pump in accordance with the teachings of the present invention can be used in a variety of applications including pouches without openings for a hand.

FIG. 6 shows a cross section of the device 10. The external tube 20 is an outlet conduit for the pump 11 and is in communication with a tube 50 that leads to a spray head 60. If spray towards the top of the device is desired, tube 50 and spray head 60 can be eliminated and the device can spray out of the opening of external tube 20. The pump 11 is contained internal to the pouch 10. In the illustrated pouch type device 10, a user's hand can be inserted into an opening 70 that is formed therein.

Figure 7:
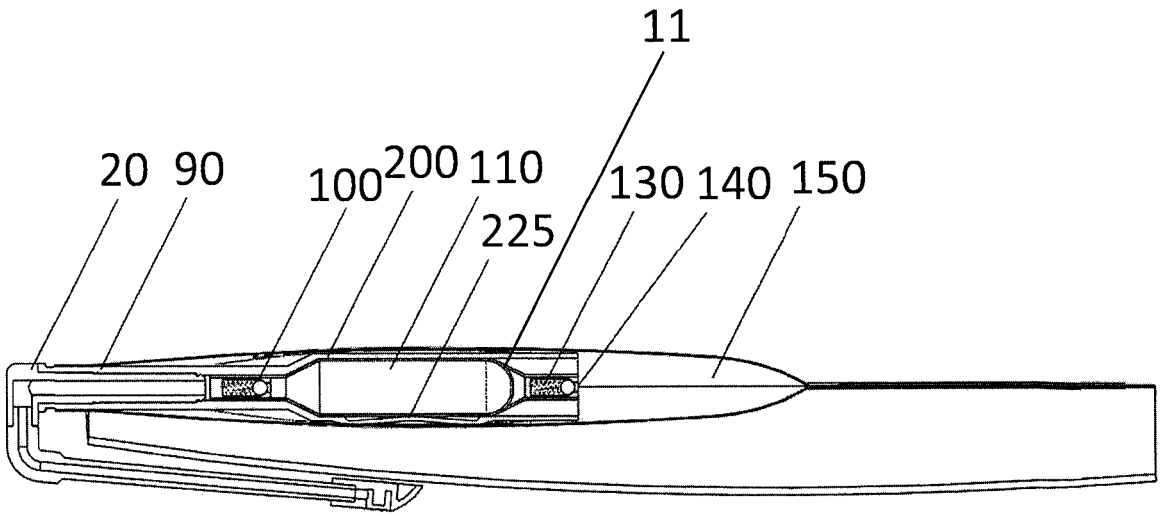
FIG. 7 is a cross-sectional view of the pump and pump sleeve in accordance with the present invention.

FIG. 7 shows another cross section of the device 10. The external tube 20 is inserted into a pump body portion 90 after the pouch reservoir is filled. The pump 11 has a hollow interior 110 for storing fluid and includes an outlet check valve 100 for controlling flow of fluid from the hollow interior 110 (of pump 11) to the external tube 20. The pump 11 also includes an inlet 140 that comprises a conduit that extends from a reservoir 150 of the pouch that stores the fluid to be dispensed to the pump 11 (i.e., the hollow interior 110 thereof). An inlet check valve 130 is provided for controlling the flow of liquid from the reservoir 150 to the hollow interior 110 of the pump 11.

Figure 8:
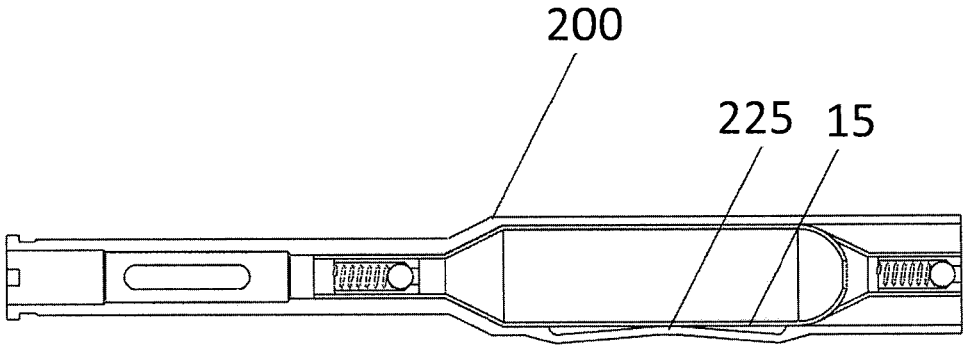
FIG. 8 is a view of the pump and pump sleeve in a first at-rest position.
Figure 9:
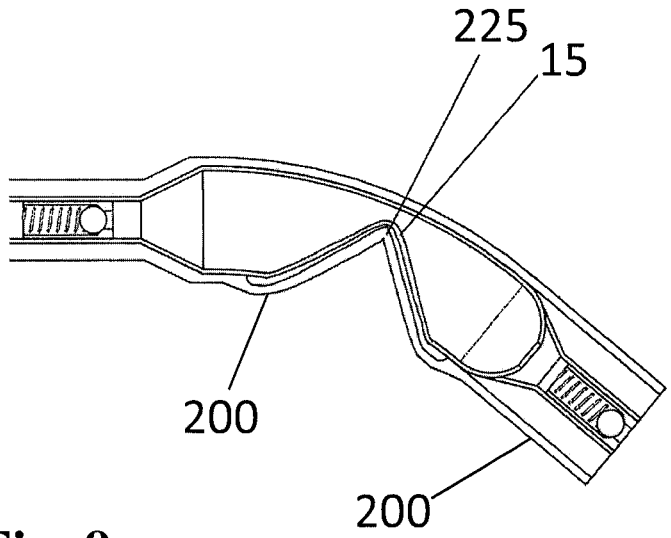
FIG. 9 is a view of the pump and pump sleeve in a collapsed position.
Figure 10:
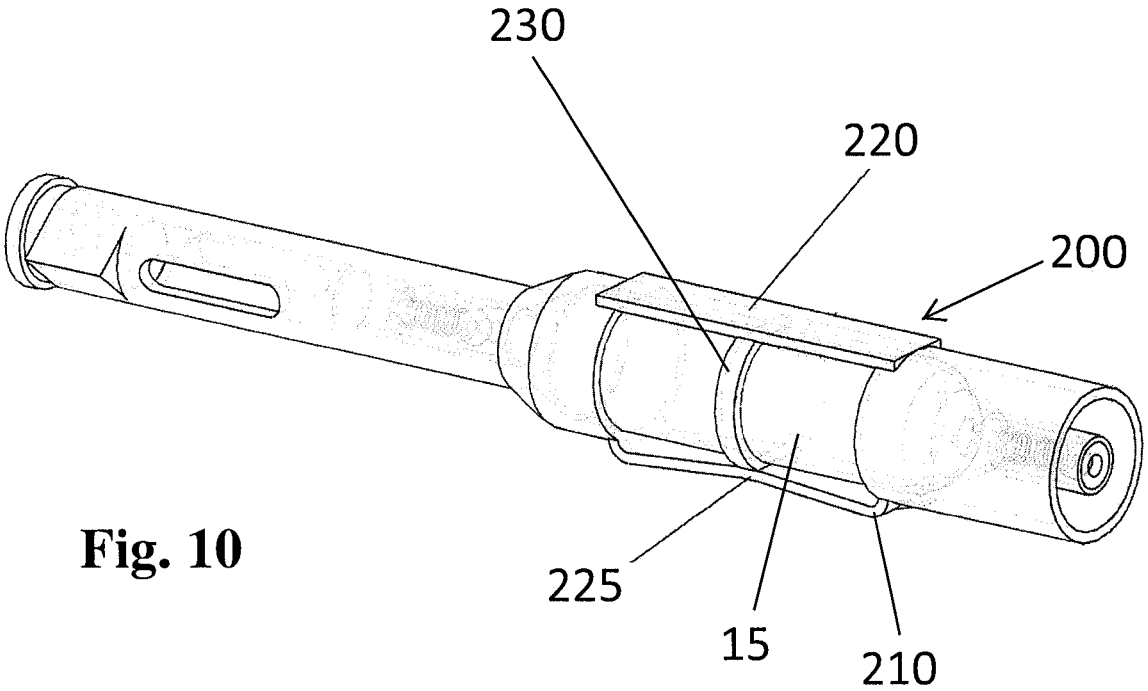
FIG. 10 is a perspective view of the pump and pump sleeve in the first at-rest position.

In accordance with the present invention, a collapsible pump sleeve (structure) 200 is provided and is fitted and coupled to a collapsible body of the pump 11 and in particular, as shown, the collapsible pump sleeve 200 surrounds the collapsible body of the pump 11 and can surround adjacent structures, such as a portion of the inlet conduit and/or outlet conduit. In some embodiments, the collapsible pump sleeve 200 can be in the form of a flexible pumping tube. In FIGS. 8-10, the collapsible body of the pump 11 is identified at 15.

As best shown in FIG. 10, the collapsible pump sleeve 200 is defined by a longitudinally extending first wall (first beam) 210 and an opposing longitudinally extending second wall (second beam) 220 with a pair of connector walls 230 extending between the first wall 210 and the second wall 220. The first wall 210 and the second wall 220 thus extend along the length of the flexible pumping tube (pump 11), while the connector walls 230 extend between the first wall 210 and the second wall 220 and thus can be thought of as being a bridge between these two walls 210, 220. The first wall 210 and the second wall 220 are disposed opposite one another and the pair of connector walls 230 can also be disposed opposite one another.

In the illustrated embodiment, the first wall 210 includes a weakened portion 225. Wall 220 is sufficiently thin and flexible enough to permit bending during flexing without cracking or breaking.

The formation of the weakened portion 225 can be done by any number of traditional techniques, including but not limited to formation of a crease or notch (a living hinge) that inherently defines a weakened portion of the first wall 210 about which the first wall 210 will bend (pivot) when a suitable force is applied. The formation of the weakened portion 225 thus creates a point about which the collapsible pump sleeve 200 will collapse when a force is applied. When a force is applied and the first beam 210 collapses (bends) about portion 225, the connector walls 230 flex outward and help restore the circular cross section to the collapsible body 15 of the pump 11 when the pump 11 is unbent. The critical bending point (portion 225) is connected integrally to the connector walls 230 of the collapsible pump sleeve 200 and to the second walls 220. Thus, the collapsible body 15 of the pump 11 is surrounded by the collapsible pump sleeve 200.

There are many materials that the collapsible pump sleeve 200 can be made of, but it is important that the pump body is capable of repeated flexing when formed into suitably thin sections. These flexures are known as living hinges. Polypropylene and polyethylene are two preferred exemplary materials for formation of the collapsible pump sleeve 200; however, other materials are possible. In addition, if the pump 11 is heat sealed into the pouch 10, polyethylene is preferred over polypropylene for its ability to bond to common polyethylene adhesive layers in the pouch materials.

FIG. 8 is a close-up of the pump 11. In this case, the pump 11 can be heat sealed into the opening of the pouch 10 to mount it in a fluid proof manner to the pouch 10. The collapsible pump sleeve 200 surrounds the flexible pump body 15 (flexible fluid member) that is capable of being deformed in order to pump the fluid. The flexible pump body 15 must return to its original shape either by itself, or when the collapsible pump sleeve 200 is unbent. As mentioned before, portion 225 is the critical pinch point that provides a flexing point of the collapsible pump sleeve 200 and allows a pumping action to occur due to the collapsing action of the pump sleeve 200 and the bending/flexing action of the pump body 15 itself.

FIG. 9 shows a detail of the pump 11 in the flexed state as a result of the bending of the pump sleeve 200 about the living hinge portion 225 which results in bending of the flexible pump body 15 (which is then translated into the disclosed pumping action). Typically, the pump 11 would be bent and unbent in a cyclical motion which each cycle expelling a set amount of fluid. As the pump assembly (pump 11 and sleeve 200) is bent downward, the first wall (beam) 210 goes into compression and the second wall (beam) 220 is in tension. The slight reverse curvature at the weakened portion (living hinge) 225 is where the pump will collapse, pinching the flexible pump body at the pinch point of flexible pump body 15. Due to the design of the sleeve 200, this relatively small flexing of the pump 11 of approximately 30 to 40 degrees causes a complete collapse of the pump 11 (pump tube) at the pinch point and can generate sufficient pressure to overcome the outlet check valve 100 and pump fluid from the pump interior. After the pump is relaxed (unbent), the flexible pump body 15 will refill, taking fluid in through the inlet 140.

The flexible pump body should be resilient and capable of surviving compression and return to its original shape. Thermoplastic elastomers, thermoplastic vulcanates, polyethylene, rubber, and silicone rubber are all be potential materials for this structure.

It may be useful for the flexible pump body 15 to be bonded to the sleeve 200 through use of adhesives or two shot injection molded in which the two materials are adhered when one melt flow bonds to the other material during mold fill.

The check valves 100, 130 can be made using a spring and ball or other valve seat material, duckbill valves, umbrella valves, or any other check valve design. These valves can be separate parts or be incorporated directly into the pump body or fluid member.

As shown in FIG. 10, the inner surface of one or more of the beams 210, 220 can have a curved surfaces to mirror and mate with the curved surface of the pump 11.

The present invention does not need to be constructed in a linear nature as shown. Any configuration of fluid path with an inlet, an outlet, and a pumpable fluid volume would work.

Alternatives

The key principal at work here is that when two links are at nearly 180 degrees to one another and are placed under compression, they can produce a strong pinching force perpendicular to those links. This same principal could be used with a piston or diaphragm type pump instead of compressing a tube.

Example

Due to basic geometric constraints, the pumping volume is generally between 0.25 and 0.5 of the fluid member volume. In experiments with a fluid member roughly 10 mm in diameter and 25 mm long, the pump displaced about 0.6 ml per cycle. That fluid member (pump body 15) can hold roughly 2 ml total.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A fluid dispensing device comprising:

a fluid reservoir for holding a fluid that is to be dispensed;

at least one fluid dispensing outlet for dispensing the fluid through the at least one fluid dispensing outlet from the fluid reservoir; and a pump that is in communication with the fluid reservoir and with the at least one dispensing outlet, the pump including a hollow deformable first pump body that holds the fluid and a deformable second pump body that surrounds the deformable first pump body and has a weakened portion that defines a bending region, whereby when the deformable second pump body is bent along the bending region, the deformable first pump body is pinched and deforms resulting in fluid being expelled from a hollow interior of the deformable first pump body;

wherein the deformable second pump body comprises an elastic sleeve that is disposed over and completely surrounds the deformable first pump body.

2. The dispensing device of claim 1, wherein the sleeve is attached to the deformable first pump body.

3. The dispensing device of claim 1, wherein the elastic sleeve comprises a first beam that extends longitudinally along a first surface of the deformable first pump body; a second beam that extends longitudinally along a second surface of the deformable first pump body and is spaced from the first beam since the first surface is opposite the second surface; and at least one connector wall extending between and connected to the first beam and the second beam, the at least one connector wall surrounding and being adjacent the deformable first pump body, the first beam having the weakened portion.

4. The dispensing device of claim 3, wherein the weakened portion comprises a reduced thickness crease formed in the first beam and the at least one connector wall is formed at a location of the weakened portion.

5. The dispensing device of claim 3, wherein the first beam and the second beam are parallel to one another and the at least one connector wall has a curved shape.

6. The dispensing device of claim 3, wherein the at least one connector wall comprises a pair of connector walls that are oriented 180 degrees apart.

7. The dispensing device of claim 1, wherein the deformable first pump body comprises an enlarged portion of a tube that has a deformable side wall.

8. The dispensing device of claim 1, further including an inlet conduit that fluidly connects the fluid reservoir to the pump and includes a first valve and an outlet conduit that leads to the dispensing outlet includes a second valve, the bending of the deformable second pump body generating enough fluid force to overcome the closing force of the second valve.

9. A fluid dispensing device comprising:

a fluid reservoir for holding a fluid that is to be dispensed;

at least one fluid dispensing outlet for selectively dispensing the fluid through the at least one fluid dispensing outlet from the fluid reservoir; and a pump that is in selective communication with the fluid reservoir and with the at least one dispensing outlet, the pump including a hollow deformable pump body that holds the fluid and provides a pumping action for pumping the fluid from the fluid reservoir to the at least one dispensing outlet;

a collapsible pump sleeve that surrounds the deformable pump body and has a weakened portion that defines a collapsing region of the collapsible pump sleeve, whereby when the collapsible pump sleeve is bent along the collapsing region, the deformable pump body is pinched and deforms resulting in fluid being expelled from a hollow interior of the deformable pump body, the collapsible pump sleeve having a first beam that extends longitudinally along one side of the deformable pump body and includes a first end section and an opposite second end section, a second beam that extends longitudinally along an opposite side of the deformable pump body, and at least one connector wall that extends between the first beam and the second beam, the weakened portion being a living hinge that is defined within the first beam between the first end section and the second end section.

10. The dispensing device of claim 9, wherein the collapsible pump sleeve and the deformable pump body can be bent and deformed together.

11. The dispensing device of claim 9, wherein the weakened portion is located along a middle of the first beam such that when the pump sleeve collapses, the deformable pump body deforms to define a first end space and a second end space with a narrowed waist defined between the first end space and the second end space.

12. The dispensing device of claim 9, wherein the first beam and the second beam are disposed 180 degrees apart.

13. The dispensing device of claim 9, wherein the at least one connector wall comprises a pair of connector walls that are spaced opposite one another.

14. The dispensing device of claim 13, wherein the pair of connector walls are located at approximately a middle section of each of the first beam and the second beam.

15. The dispensing device of claim 9, further including a pouch for receiving a hand, the at least one fluid dispensing outlet including a flexible tube that extends outwardly from the pouch.

16. The dispensing device of claim 9, further including an inlet conduit that fluidly connects the fluid reservoir to the pump and includes a first valve and an outlet conduit that leads to the dispensing outlet includes a second valve, the bending of the deformable second pump body generating enough fluid force to overcome the closing force of the second valve.

* * * * *